US007013825B1

(12) United States Patent
D'Alessandro

(10) Patent No.: US 7,013,825 B1
(45) Date of Patent: Mar. 21, 2006

(54) JACK PLATE OPERATED TRIM FOR POWER BOATS

(76) Inventor: David A. D'Alessandro, 210 North Rd., Clemons, NY (US) 12819

( * ) Notice: Subject to any disclaimer, the term of this patent is extended or adjusted under 35 U.S.C. 154(b) by 0 days.

(21) Appl. No.: 10/957,148

(22) Filed: Sep. 30, 2004

(51) Int. Cl.
*B63B 1/22* (2006.01)

(52) U.S. Cl. ..... 114/286

(58) Field of Classification Search ..... 114/284–286
See application file for complete search history.

(56) References Cited

U.S. PATENT DOCUMENTS 3,370,561 A * 2/1968 Bengt ..... 114/285
3,371,642 A * 3/1968 Joy ..... 114/285
3,628,484 A * 12/1971 Banner ..... 114/285
4,896,622 A * 1/1990 Thomas ..... 114/285

OTHER PUBLICATIONS

U.S. Appl. No. 10/843,986, filed May 12, 2004.

* cited by examiner

*Primary Examiner*—Jesus D. Sotelo
(74) *Attorney, Agent, or Firm*—M. P. Williams

(57) ABSTRACT

A jack plate (9) moveable upwardly and downwardly between various positions has a trim tab (28) disposed on a fixed portion (10) of the jack plate near the base of the transom (11) of a boat. The moveable portion (12) of the jack plate has a push cap (44) that, at a pickup position of the jack plate, pushes a rod (43) which rotates a lever (38) to move an arm (33) to push the trim tab (28) into an operative position aft of and below the hull of the boat. Above the pickup position, the push cap does not contact the rod; a return spring (50) causes the trim tab (28) to rotate upwardly, into a position where it is ineffective.

4 Claims, 3 Drawing Sheets

JACK PLATE OPERATED TRIM FOR POWER BOATS

TECHNICAL FIELD

This invention relates to providing additional trim to a power boat at low speed, thereby to lift the stern and obtain plane more quickly, the trim being automatically effected by a power jack plate, to which an outboard motor is secured, thereby to be raised and lowered.

BACKGROUND ART

It is well known that when a power boat accelerates from a standstill, the nose goes high and the stern goes low until a certain speed is obtained, which typically is between 20 and 30 miles per hour. Then the boat levels off and is said to be on plane. It is for this reason that transoms tilt so as to be closer to the bow below the water line, thereby to provide some upward thrust on the stern during initial acceleration.

In U.S. Pat. No. 2,886,462, an outboard motor is on a flexible transom plate which causes the motor to be trimmed forward, thereby providing downward thrust when the boat starts up from a standstill, the base of the transom plate acting as a trim tab. When some speed is attained, the force of the water against the bottom of the transom plate causes the motor to level off. The transom is always in the same trim position as the motor, with no choice, and with no control thereover by the operator.

Modern bass boats and ski boats have power trim which allows the operator to tilt the propeller aft and upwardly once plane has been attained, thereby to keep the bow of the boat from plowing, and reduce drag, so that higher speeds may be attained and less effort of the motor is required to achieve any given speed.

Trim tabs have been provided at the aftmost extreme of the hull, extending downwardly somewhat from the bottom of the hull. Static trim tabs however remain in place at higher speeds and thereby produce significant drag, which reduces speed and wastes fuel. Adjustable trim tabs are complex and require electric or hydraulic mechanisms together with operator controls and communication between the mechanisms and the controls.

Referring to FIG. 1, a power-operated transom jack, commonly and herein referred to as a jack plate 9, known to the prior art, has two sides; each side includes a stationary portion 10 fastened to the transom 11 of a boat, and a moveable portion 12 having slots 13 that allow the moveable portion to slide on pins 14 disposed on the stationary portion 10. Depicted diagrammatically is a hydraulic cylinder 17 which responds to fluid in tubing 18 to raise and lower the moveable portion 12.

A trim plate 21 is fastened, as by bolts 22, to the bottom of the moveable portion 12. The portions 10, 12, do not extend from one side to the other, but rather there are similar portions fastened to the transom at the other side of the jack plate (not shown). The trim plate 21, however, is solid from one side of the moveable portion 12 to the other side of a similar moveable portion (not shown).

In the position shown in FIG. 1, the trim plate 21 has no effect, since the path of even its lagging edge 25 is not through water behind the transom 11. If the moveable portion 12 were moved downwardly until the trim plate 21 extended substantially from the bottom of the transom 11, as shown by the fractional dotted lines 26, the trim plate 21 would provide lift and assist the boat in reaching plane while accelerating from rest. However, it would also, as is the case of fixed trim tabs, provide drag and possibly reduce steerability at higher speeds.

Should the moveable portion 12 be positioned below that indicated by the dotted lines 26, it would act as a scoop and direct water upwardly into the jack plate and actually into the boat itself.

Therefore, the exact positioning of the jack plate is critical when employing a trim plate 21 as in FIG. 1.

DISCLOSURE OF INVENTION

Objects of the invention include: providing low speed upward trim automatically in response to the position of a jack plate; trimming which is responsive to the power of the boat's jack plate; preventing backwash through the jack plate when coming down off plane; and using the jack plate of the boat to create additional trim providing lift to the stern of the boat at low speeds, and providing no drag at all at higher speeds.

According to the present invention, the stern of the boat is lifted during acceleration at very low speeds by means of at least one trim tab which is moved downwardly into a full lift position by the boat's jack plate when the jack plate is in a selected position below a pickup position, and which is rapidly raised to a position where it is out of the water, thereby providing absolutely no drag, in response to the jack plate being raised a small amount above the selected position. By being coupled to the boat's jack plate, the stern-lifting trim tab of the invention is automatically in place when desired, and out of the way when trim is not desired, and controlled by an operator positioning the jack plate. The invention is readily adapted to a wide variety of outboard boats and hulls.

According to the invention still further, one embodiment of the invention has a push cap that provides free play of the jack plate at higher positions, but engages a push rod at lower jack plate positions, the push rod being connected with at least one trim tab so that as the jack plate reaches the selected position, the push cap engages the push rod and causes the trim tab to be lowered into the water, below the fair line of the hull bottom.

The invention obviously can be utilized with one trim tab or several trim tabs, and with one or more actuators on each trim tab.

The invention provides significant stern lift when desired, but provides no drag when none is desired, all of the motion of the trim tab being controlled by the power-actuated jack plate already installed on the boat.

Other objects, features and advantages of the present invention will become more apparent in the light of the following detailed description of exemplary embodiments thereof, as illustrated in the accompanying drawing.

MODE(S) FOR CARRYING OUT THE INVENTION

Figure 1:
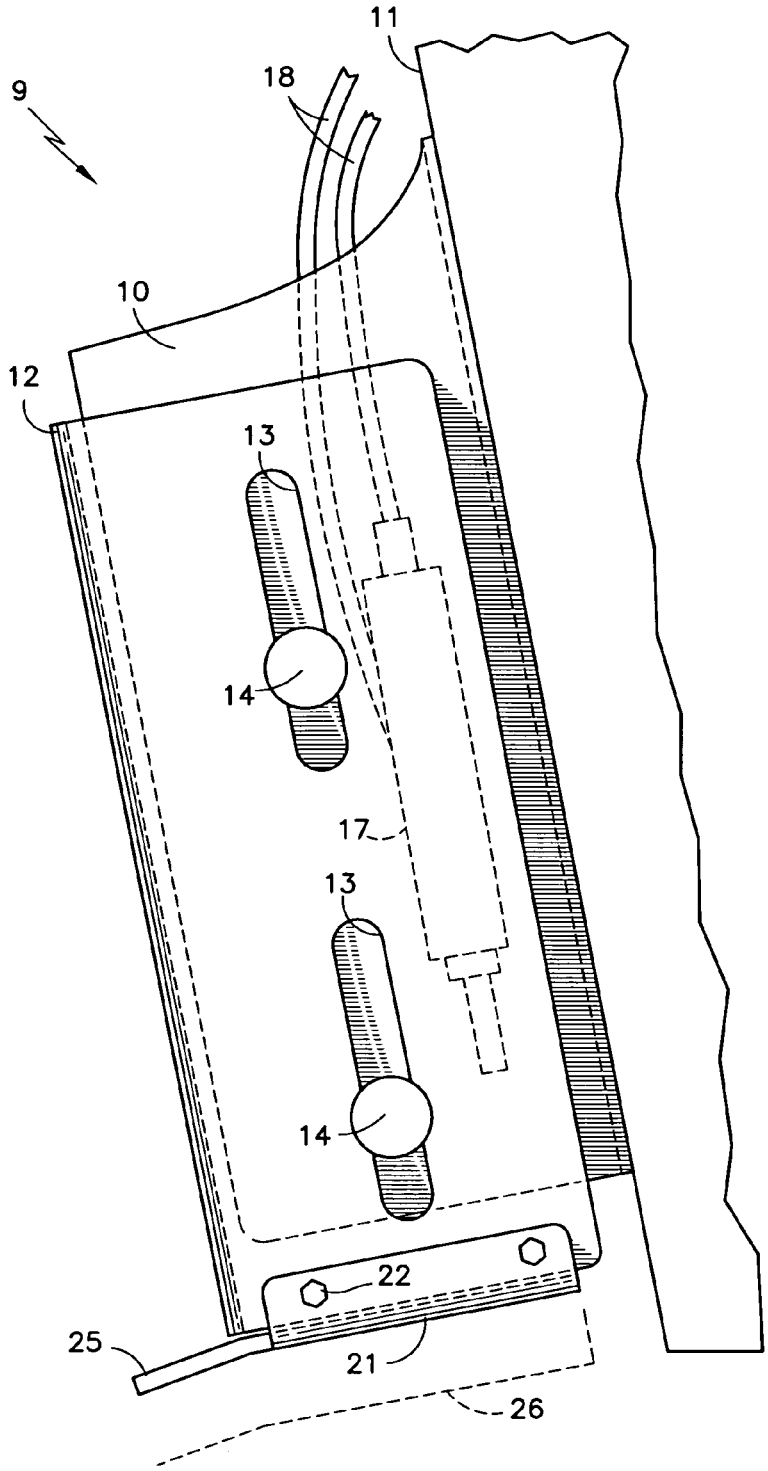
FIG.1 Prior Art
FIG. 1 is a side elevation view of a jack plate having a fixed trim plate, known to the prior art.
Figure 2:
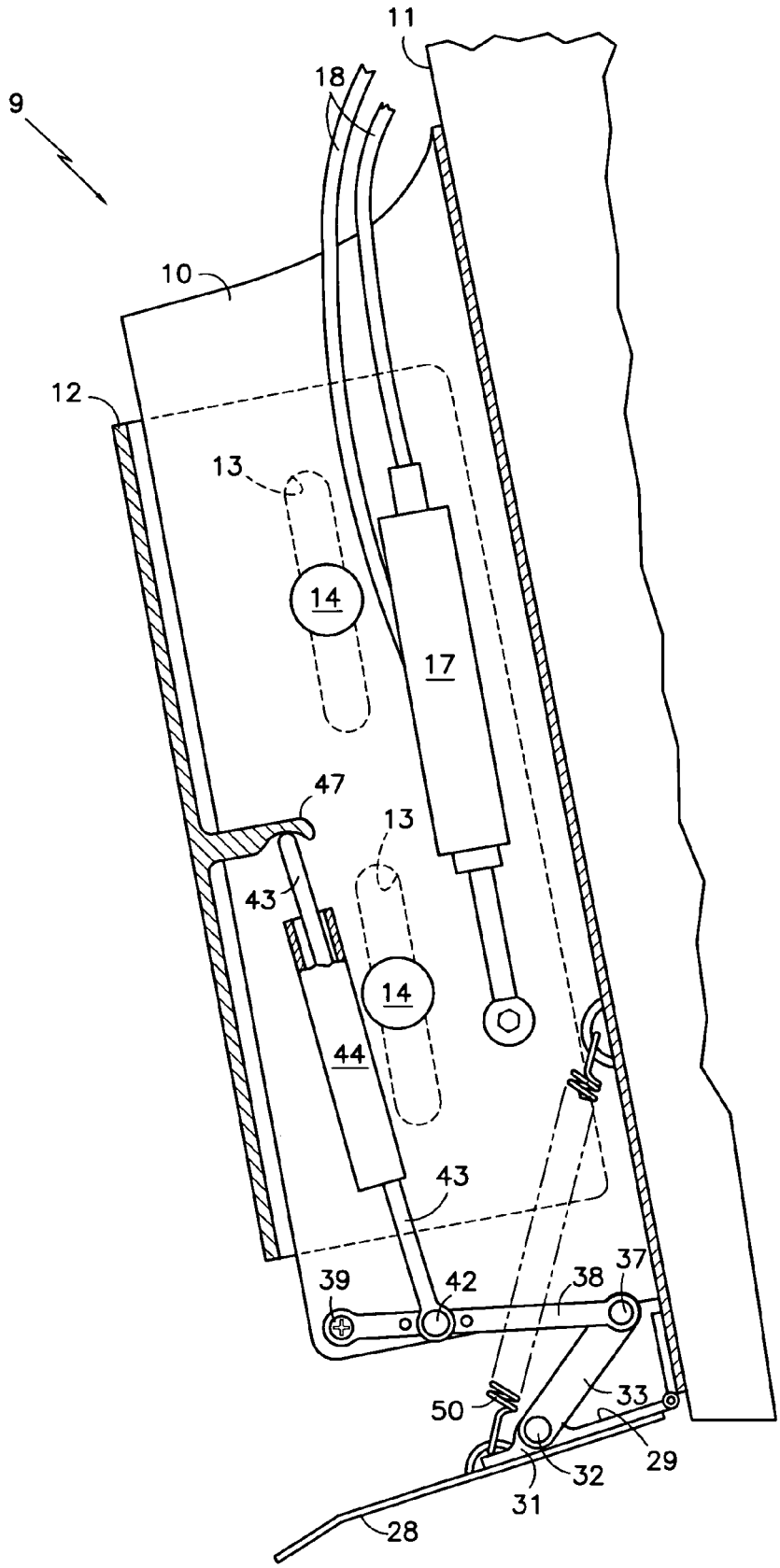
FIG. 2 is a partial, partially sectioned, side elevation view of one embodiment of the invention, when the trim tab is down.
Figure 3:
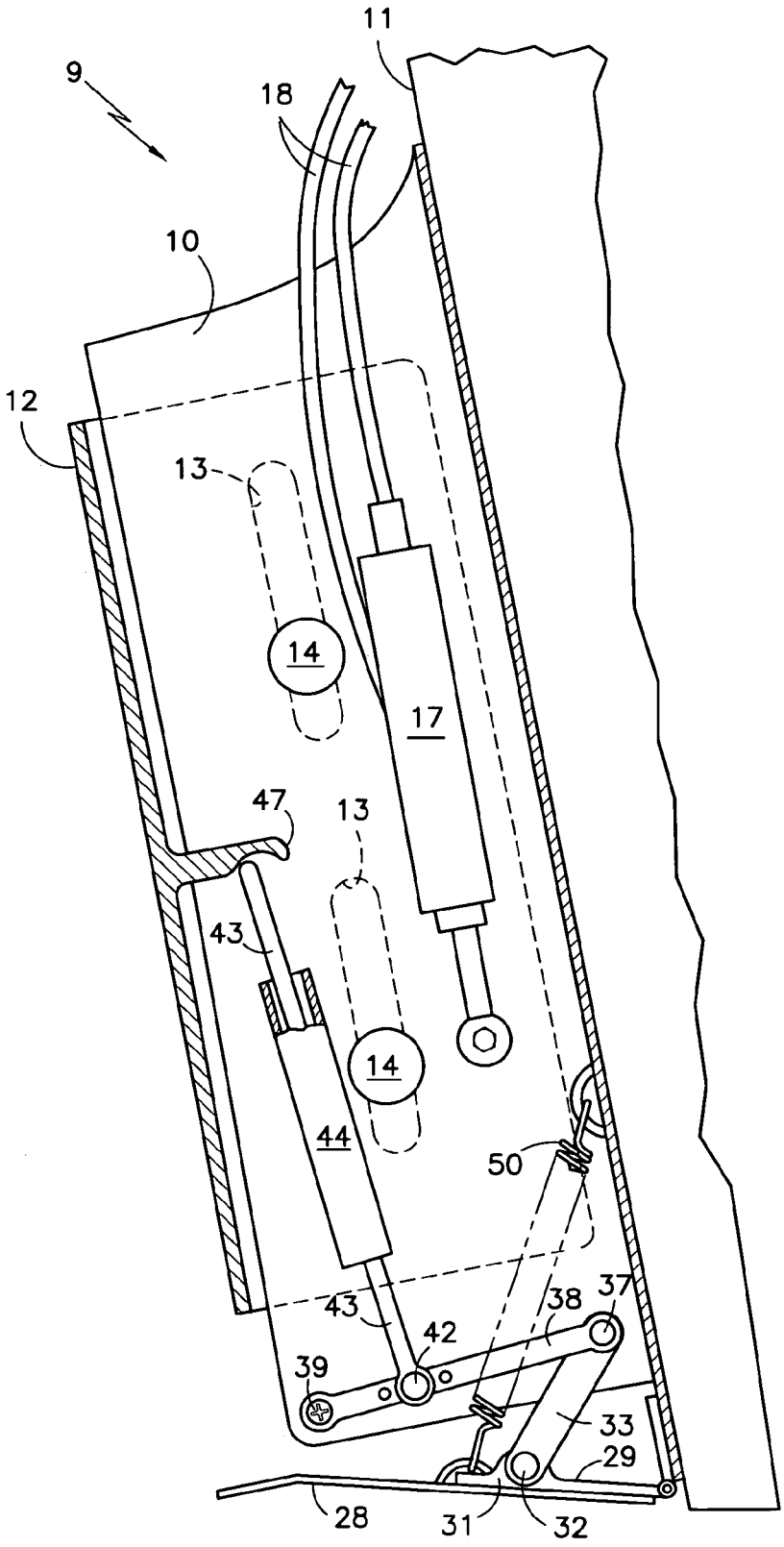
FIG. 3 is a partial, partially sectioned, side elevation view of one embodiment of the invention, when the trim tab is up.

Referring to FIG. 2, a trim tab 28 is rotatably disposed at the base of the transom by means of a piano hinge or other suitable hinge 29 so that the trim tab can rotate upwardly and downwardly in response to different positions of the jack plate, as illustrated in FIGS. 2 and 3.

In FIG. 2, the power-operated jack plate 9 is in an intermediate position, and the trim plate 28 extends below the fair line of the hull. As the jack plate is raised a little bit, as illustrated in FIG. 3, the trim tab 28 rotates into a fully upward position, where it is out of the water and has absolutely no effect. As the position of the jack plate is increased further due to a lost-motion effect described hereinafter, the trim tab remains in its fully upward position, independently of further upward motion of the jack plate 12.

In FIG. 2, the hinge 29 has an extension 31 which receives a pin 32 that rotatably disposes one end of an arm 33. The other end of the arm 33 is rotatably disposed by a pin 37 to an arm 38 which is rotatably anchored by a screw or other suitable fastener 39 to the fixed portion 10 of the jack plate. The arm 38 is rotatably connected by a pin 42 to a rod 43 that passes through a guide tube 44 to a position in which the end of the rod 43 may or may not engage a push cap 47 that is fastened to the moveable portion 12 of the jack plate.

The push cap 47 is disposed on the moveable portion 12, which is shown in FIG. 2 at some arbitrary position in which the trim tab 28 is below the transom 11 in an effective position.

In FIG. 3, the push cap 47 has been raised as a consequence of the jack plate, that is, the moveable portion 12, to which the motor is fastened, having been raised. This causes the trim tab 28 to be raised up above the bottom of the hull, where it is no longer in the water at moderate and high speed; but it prevents backwash, scooping water up through the jack plate and into the boat, as the boat comes down off plane. It is assumed that there is a stop (not shown) that will prevent a spring 50 from raising the trim tab any further even though the moveable portion 12 may move higher thus moving the push cap 47 away from the rod 43. The point at which the anvil 47 and the rod 43 no longer contact each other is called the pickup point; the anvil 47 will push the rod 43 when the jack plate is positioned below the pickup point, and the rod 43 will remain unmoved at any position of the jack plate above the pickup point.

The stationary portion 10 of the jack plate may form a stop for the trim tab 28, depending upon the relative widths of the jack plate and the trim tab 28. Provision of the stop is straightforward, and the nature thereof forms no part of the present invention.

The invention is well suited for use with automatic jack plates which have a dial or other easily settable control so that the operator of the boat can select a particular position of the jack plate (upwardly and downwardly). In such a case, the operator may select a position of the jack plate which is a small distance, such as half of an inch (more or less), lower than the lowest position that the operator believes he will desire to utilize when operating the boat at intermediate and higher speeds. Then the operator can dial (or otherwise select) the selected low position in order to engage the trim tab, and once under way, dial his normal, cruising jack plate position, thereby raising the trim tab to a position where it is ineffective.

The embodiment herein is merely expressive of the functions required in order to practice the invention: controlling a trim tab in response to the position of a jack plate. The invention is shown implemented in a jack plate in which the moveable portion is outside of the stationary portion, but is easily implemented in a jack plate in which the stationary portion is outside of the moveable portion. Similarly, cables, hydraulics, electrics, or other mechanisms, rather than rods and/or levers, may be utilized for at least a portion of the sensing and operating mechanisms. The guide tube 44 may be smaller; in fact, a simple loop or a pair of pins may be used to keep the rod 43 in line with the push cap 44. The spring 50 may be connected to the elbow at pin 37, if desired. The rod 43 may be actuated by mechanisms other than the push caps 44.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

I claim:

1. A trim system for a power boat having a hull with a transom, said system comprising:

a power-operated jack plate mounted on the transom of the boat, said jack plate being adjustable upwardly and downwardly between various positions;

at least one trim tab disposed to rotate about a point near a base of the transom of the boat between (a) a position aft of and lower than the bottom of the hull of the boat and (b) a position where the trim tab is substantially out of water and of no adverse effect when the boat is moving above low speed;

first means operable between a first position and a second position and connected to said at least one trim tab so that said at least one trim tab is in said position (a) when said first means is in said first position and is in said position (b) when said first means is in said second position; and second means responsive to the position of said jack plate to position said first means in said first position when said jack plate is in a selected position below a pickup position, and to position said first means in said second position whenever said jack plate is in a position above said pickup position.

2. A method of operating at least one trim tab on a power boat having a hull with a transom, and a power-operated jack plate disposed on the transom, said jack plate being adjustable upwardly and downwardly between various positions, said at least one trim tab disposed to rotate about a point near a base of the transom of the boat between (a) a position aft of and lower than the bottom of the hull of the boat and (b) a position where the trim tab is substantially out of water and of no adverse effect when the boat is moving above low speed, said method comprising:

sensing the position of said jack plate; and positioning said trim tab in direct response to the position of said jack plate.

3. Apparatus for operating at least one trim tab on a power boat having a hull with a transom, and a power-operated jack plate disposed on the transom, said jack plate being adjustable upwardly and downwardly between various positions, said at least one trim tab disposed to rotate about a point near a base of the transom of the boat between (a) a position aft of and lower than the bottom of the hull of the boat and (b) a position where the entire trim tab is substantially out of water and of no adverse effect when the boat is moving above low speed, comprising:

first means for sensing the position of said jack plate; and means responsive to said first means for positioning said trim tab in direct response to the position of said jack plate.

4. A power-operated jack plate for mounting on the transom of a power boat having a hull, said jack plate being adjustable upwardly and downwardly between various positions, said jack plate comprising:

at least one trim tab disposed to rotate about a point which, when the jack plate is mounted on the transom of a boat, is near a base of the transom between (a) a position aft of and lower than the bottom of the hull and (b) a position where the trim tab is substantially out of water and of no adverse effect when the boat is moving above low speed;

first means operable between a first position and a second position and connected to said at least one trim tab so that said at least one trim tab is in said position (a) when said first means is in said first position and is in said position (b) when said first means is in said second position; and second means responsive to the position of said jack plate to position said first means in said first position when said jack plate is in a selected position below a pickup position and to position said first means in said second position whenever said jack plate is in a position above said pickup position.

* * * * *